US007918056B2

(12) United States Patent
Yamaguchi

(10) Patent No.: US 7,918,056 B2
(45) Date of Patent: Apr. 5, 2011

(54) UNDERGROUND SHELTER

(75) Inventor: Tadamasa Yamaguchi, Katou (JP)

(73) Assignee: Nihon Shelter System Co., Ltd., Hyogo (JP)

( * ) Notice: Subject to any disclaimer, the term of this patent is extended or adjusted under 35 U.S.C. 154(b) by 243 days.

(21) Appl. No.: 12/226,926

(22) PCT Filed: May 1, 2007

(86) PCT No.: PCT/JP2007/059797

§ 371 (c)(1), (2), (4) Date: Oct. 31, 2008

(87) PCT Pub. No.: WO2007/126161

PCT Pub. Date: Nov. 8, 2007

(65) Prior Publication Data

US 2009/0064604 A1 Mar. 12, 2009

(30) Foreign Application Priority Data

May 1, 2006 (JP) ..... 2006-154007

(51) Int. Cl.
*E02D 27/00* (2006.01)

(52) U.S. Cl. ..... 52/169.6; 52/169.14; 52/425

(58) Field of Classification Search ..... 52/169.6, 52/169.14, 234, 236.3, 742.1, 19, 20, 21, 52/425; 109/1 S See application file for complete search history.

(56) References Cited

U.S. PATENT DOCUMENTS

| | | | | |
|---|---|---|---|---|
| 3,049,835 | A * | 8/1962 | Sundstrum | 52/169.6 |
| 4,631,872 | A * | 12/1986 | Daroga | 52/1 |
| 5,022,202 | A * | 6/1991 | Johnson, Jr. | 52/169.6 |
| 5,115,613 | A * | 5/1992 | McCarthy | 52/169.6 |
| 6,061,976 | A * | 5/2000 | Willbanks, Jr. | 52/169.6 |
| 6,085,475 | A * | 7/2000 | Parks et al. | 52/169.6 |
| 6,196,761 | B1 * | 3/2001 | Stanton et al. | 405/53 |
| 6,308,471 | B1 * | 10/2001 | Raynor | 52/169.6 |
| 6,385,920 | B1 * | 5/2002 | Chandler | 52/169.6 |
| 6,438,907 | B1 * | 8/2002 | McCarthy | 52/169.6 |
| 6,938,381 | B1 * | 9/2005 | Villa | 52/79.1 |
| 7,428,800 | B1 * | 9/2008 | Vaughn et al. | 52/19 |
| 2002/0124490 | A1 * | 9/2002 | McCarthy | 52/169.6 |
| 2003/0167708 | A1 * | 9/2003 | Shaw et al. | 52/169.6 |

FOREIGN PATENT DOCUMENTS

| | | |
|---|---|---|
| JP | 61-113973 | 5/1986 |
| JP | 61-178463 | 8/1986 |
| JP | 64-38771 | 3/1989 |
| JP | 3-202510 | 9/1991 |
| JP | 4-136322 | 5/1992 |
| JP | 8-134996 | 5/1996 |
| JP | 9-42716 | 2/1997 |

(Continued)

*Primary Examiner* — Brian E Glessner
*Assistant Examiner* — Beth Stephan
(74) *Attorney, Agent, or Firm* — Clark & Brody

(57) ABSTRACT

A hole is drilled at a depth of about 5 to 6 m from the ground surface, a shelter outer shell floor slab 3 is provided, and a shelter inner shell 1 is provided thereon. Next, a load-bearing partition wall 6 is provided in the shelter inner shell 1, and thereafter a shelter outer shell 2 is provided and integrated. If required, a neutron beam-shielding shell 4 is provided at the outer surface-side of the wall section and the ceiling section of the shelter outer shell 2 or the shelter inner shell 1-side to subsequently backfill the beam-shielding shell 4.

11 Claims, 12 Drawing Sheets

FOREIGN PATENT DOCUMENTS

| | | |
|---|---|---|
| JP | 9-78609 | 3/1997 |
| JP | 9-228393 | 9/1997 |
| JP | 11-21916 | 1/1999 |
| JP | 11-21917 | 1/1999 |
| JP | 2001-305278 | 10/2001 |
| JP | 2002-162493 | 6/2002 |
| JP | 2004-323304 | 11/2004 |
| JP | 2005-240452 | 9/2005 |

* cited by examiner

UNDERGROUND SHELTER

TECHNICAL FIELD

The present invention relates to an underground shelter that has shielding property, durability, and functionality in addition to earthquake protection and waterproofing properties and that is safer.

BACKGROUND ART

To date, various underground shelters and underground rooms have been suggested. The underground shelters and underground rooms are common in that a space is provided underground but require different concepts regarding the structures depending on the objectives thereof. Generally, underground rooms are used as a room for hobbies and entertainment (e.g., audio room, music lessen room, living room, bed room). Thus, such underground rooms are required that can be built with a shorter work period and with a lower cost within a range which satisfies legal conditions for a residential underground room. There has been a tendency where this point has been prioritized as a development subject. On the other hand, the first objective of the underground shelter is to safely protect persons or articles therein from various assumed risk factors from the outside. Thus, the underground shelter has been required to have a simpler and sturdier structure and an expert security structure against risk factors.

An underground shelter disclosed in Japanese Unexamined Patent Publication No. 2005-240452 (Patent Document 1) has a main body structure in which a pressure-tight base supported by a plurality of piles driven in the ground has thereon a box-like shelter inner shell made of high-strength concrete. An outer surface constituting a wall and a ceiling face except for the bottom face of the shelter inner shell is covered by the shelter outer shell made of an iron plate. The outer surface of the iron plate, and a space between the bottom face of the shelter inner shell and the pressure-tight base is covered by the waterproof coating.

An underground room disclosed in Japanese Unexamined Patent Publication No. 78609/1997 (Patent Document 2) has a main body structure in which the outer surface of a core member such as a section steel is fixed with a metal plate, the interior of the core member is fixed with a non-metal-base inner plate to form a floor panel, a wall panel, and a ceiling panel. By the use of these panels, there is formed a box-like unit which has a double housing type rigid-frame structure in the short side direction and an earthquake-resistant wall structure in the long side direction. These units are provided and are joined to provide a building frame. The entire area of the outer surface is covered by an organic solvent coating, a synthetic resin coating, and a synthetic resin mortar.

An underground room disclosed in Japanese Unexamined Patent Publication No. 21916/1999 (Patent Document 3) has a main body structure in which a floor section is composed of a base slab made of reinforced concrete, a wall section is composed of a steel-made wall panel, and a ceiling section is composed of a steel-made roof panel. The underground room is particularly characterized in that the lower end of the steel-made wall panel is buried in the concrete of the base slab.

An underground room disclosed in Japanese Unexamined Patent Publication No. 21917/1999 (Patent Document Publication 4) has a main body structure in which a floor section is composed of a steel-made floor panel or reinforced concrete, a wall section is composed of a steel-made wall panel, and a ceiling section is composed of steel-frame beam and a wooden board, or concrete or reinforced concrete. The wall panel is subjected to corrosion-resistant and rust prevention processings and a backfilling by providing a concrete wall on the outer surface of the steel-made wall panel.

[Patent Document 1] Japanese Unexamined Patent Publication No. 2005-240452

[Patent Document 2] Japanese Unexamined Patent Publication No. 78609/1997

[Patent Document 3] Japanese Unexamined Patent Publication No. 21916/1999

[Patent Document 4] Japanese Unexamined Patent Publication No. 21917/1999

DISCLOSURE OF INVENTION

Problems to be Solved by the Invention

However, the structures of the underground shelters and the underground rooms disclosed in these four publications have some disadvantages.

In the case of the underground shelter disclosed in Japanese Unexamined Patent Publication No. 2005-240452 (Patent Document 1), the pressure-tight base has thereon the shelter inner shell made of high-strength concrete and the outer surface of the shelter inner shell is covered by the shelter outer shell made of an iron plate except for the bottom face of the shelter inner shell that is a joint area with the pressure-tight base. Thus, a case may be considered where water may intrude through this floor section into the main body of the shelter. The outer side of the shelter outer shell has a waterproof coating made of rubber asphalt and a similar waterproof coating is also provided between the bottom face and the pressure-tight base, thus preventing the water intrusion from the bottom face. This structure of the bottom face of the main body of the shelter and the pressure-tight base is considered to have some disadvantages not solved yet in order to satisfy the objective. For example, there may be no problem when the main body of the shelter is joined to the pressure-tight base supported by the piles with a very high attachment force in a weak ground at a high underground water level. However, this structure causes the waterproof coating formed between the bottom face and the pressure-tight base to have thereon the main body of the shelter. Thus, when a big earthquake occurs, the surrounding ground may be liquefied to cause a significant buoyant force which is combined with the shearing force by the quake to cause the bottom face of the shelter inner shell to be peeled from the waterproof coating or the bottom face and the waterproof coating are buoyant from the pressure-tight base. Furthermore, even a small defect such as a flaw in the waterproof coating also causes the water intrusion into the shelter interior, which is also disadvantageous against the earthquake-resistant property and the waterproofing property. Furthermore, when the shelter is provided at a shallow depth and covered by cover soil having a thin thickness, the iron plate provided at the outer surface causes a disadvantage against the fire resistance and the heat resistance.

The underground shelter is required to minimize the influences by a blast wave, blast wave-related shock wave, oscillation, nuclear radiation, bomb pieces, dust, gas, fire disaster, heat and electromagnetic wave while satisfying the construction cost and ground conditions. Thus, the shelter is desirably provided at a deep depth and the ceiling surface is desirably covered by soil. However, in the case of Japanese Unexamined Patent Publication No. 78609/1997 (Patent Document 2) intended to provide the structure of a steel-made underground room, the main structure is a box-like unit composed of a section steel, an outer metal board, and an inner non-metal inner plate. In the case of Japanese Unexamined Patent Publication No. 21916/1999 (Patent Document 3) and Japanese Unexamined Patent Publication No. 21917/1999 (Patent Document 4), the main structure is composed of the steel-made panel or the reinforced concrete slab. Thus, when the main body of the shelter is composed of these structure members, there is limitation on the sufficient structural safety and earthquake protection against a significant external force. When the shelter is provided at a deep depth in order to improve the shielding property however, an earth pressure is increased and thus it is difficult and is disadvantageous. In the case of Japanese Unexamined Patent Application Publication No. 21917/1999 (Patent Document 4), the steel-made underground room is surrounded by a concrete wall for the corrosion-resistant and rust prevention of a steel-made wall panel so that the concrete wall also functions to backfill the periphery of the outer wall of the underground room. In this case however, the concrete wall is not recognized as the one obtained by calculating the structure in order to bear the external force. Thus, this structure is not a basic structure that can secure the strength that should be owned by the underground shelter.

Furthermore, in the case of Japanese Unexamined Patent Publication No. 21916/1999 (Patent Document 3), in addition to the disadvantage in the structural safety stated above, it is considered that a joint part of a concrete floor slab and a concrete wall panel tends to have a craze called a crack at the concrete covering the lower end of the wall panel. This crack may cause water leakage, which is disadvantageous in the waterproofing property.

In the case of Japanese Unexamined Patent Publication No. 21917/1999 (Patent Document 4), in addition to the disadvantages in the structural safety, the earthquake protection, and the shielding property stated above, when the section, in particular the ceiling section is composed of a steel-frame beam and a wooden board, the structure is a very disadvantageous for preventing the water immersion during flood. Thus, this structure is disadvantageous in the shielding property, the heat insulation property, and the airtightness to the nuclear radiation, fire disaster, and heat.

As described above, although the configurations disclosed in the four Patent Documents may work in the earthquake protection and the waterproofing property, none of these configurations is recognized as being able to securely protect the interior against the strong destructive energy from weapons used in emergency situations and natural disaster or against elements having special natures and effects such as nuclear radiation and electromagnetic wave.

Means for Solving Problems

The present invention relates to a safer underground shelter that has, in addition to the earthquake protection and the waterproofing property, the shielding property, durability and the functionality and that solves the disadvantages as described above.

In order to achieve the above objective, the underground shelter according to the present invention includes: a shelter outer shell made of high-strength reinforced concrete; a box-like shelter inner shell that is provided in the shelter outer shell and that is made of a metal plate; and a load-bearing partition wall that partitions the interior of the shelter provided in the shelter inner shell to two or more compartments. The inner shell of the shelter has an opening at a position of a ceiling section of the load-bearing partition wall formed in the shelter inner shell. The load-bearing partition wall is formed by flowing ready-mixed concrete through an opening provided in the ceiling section of the shelter inner shell to subsequently seal the opening with a metal cover.

The underground shelter according to the present invention includes: a shelter outer shell made of high-strength reinforced concrete; a box-like shelter inner shell that is provided in the shelter outer shell and that is made of a metal plate; and a load-bearing partition wall that partitions the interior of the shelter provided in the shelter inner shell to two or more compartments. The inner shell of the shelter has an opening at a position of a ceiling section of the load-bearing partition wall formed in the shelter inner shell. The load-bearing partition wall is formed by flowing ready-mixed concrete through an opening provided in the ceiling section of the shelter inner shell to subsequently seal the opening with a metal cover. The shelter is buried in soil. Thus, all six planes at the upper and lower sides, the front and rear sides, and the left and right sides of the main body of the box-like shelter are constituted by the inner shell and the outer shell of the shelter, respectively. Thus, all planes have thereon homogeneous armored walls. In particular, the metal plate provided not on the outer surface of the shelter outer shell but on the inner surface can provide a structure that can securely shield water and moisture in all directions while providing the fireproof and heat resistance performances. This can solve the disadvantages related to the fire resistance, heat resistance, and waterproofing properties.

Furthermore, the underground shelter according to the present invention is so formed that the box-like shelter inner shell made of a metal plate includes therein a load-bearing partition wall made of high-strength reinforced concrete so that the load-bearing partition wall is separated from the shelter outer shell and the interior of the shelter inner shell is divided to two or more compartments.

The load-bearing partition wall of the underground shelter according to the present invention is formed by flowing ready-mixed concrete through the opening provided in the ceiling section of the shelter inner shell to subsequently seal the opening with a cover made of a metal plate.

The load-bearing partition wall of the underground shelter according to the present invention is composed of the high-strength reinforced concrete and a metal plate.

In order to secure the strength which is sufficient to resist destructive external forces acting on the main body of the shelter (e.g., earthquake motion, the shock wave and the blast wave pressure due to an explosion), the shelter outer shell has quality and size and shape determined based on a structural calculation. Based on values calculated theoretically, the shelter outer shell made of high-strength reinforced concrete is formed to have a structure bearing an external force. Thus, the shelter inner shell may have a structure that does not have to bear this external force. Thus, the structure can satisfy distortion resistance strength, a waterproofing property, and an electromagnetic wave-shielding property for example required for the construction.

Gamma radiation can be shielded very effectively by the shelter inner shell made of a metal plate including many heavy elements effective to shield gamma radiation, concrete of the ceiling slab of the shelter outer shell similarly including many heavy elements, and soil including many heavy elements which covers the shelter at a deep depth.

In order to shield neutron beam, it is important to reduce the speed of neutron beam so that neutron beam can be easily absorbed and trapped by atom cores. Since hydrogen has substantially the same mass as that of neutron, hydrogen is very effective to reduce the speed of neutron. Thus, the neutron beam-shielding material is made of substance including a great amount of hydrogen or water (e.g., water, concrete, paraffin). Concrete includes as high as 7 to 20% of water, and calcium and silicon, which are main components of cement and sand, have the same absorption capacity to neutron beam of a low speed as that of hydrogen. Thus, concrete is superior shielding material to neutron beam. Reinforcing steel is mainly composed of iron for which neutron beam of a high speed is difficultly reduced but the absorption capacity to neutron beam of a low speed is as high as 10 times higher than that of hydrogen. Thus, a double structure composed of the shelter outer shell made of high-strength reinforced concrete and the shelter inner shell made of a metal plate of iron is also very effective to shield neutron beam.

Also according to the underground shelter of the present invention, the box-like shelter inner shell made of a metal plate has a haunch chamfered face.

Also according to the underground shelter of the present invention, the box-like shelter inner shell made of a metal plate is composed of a plurality of standardized units and panels.

Also according to the underground shelter of the present invention, the box-like shelter inner shell made of a metal plate is connected to the ground covering the entirety of the main body of the shelter via a grounding wire member to provide an electrical grounding wire. The grounding wire member may be a metal cord, a metal bar, a metal board, or the combination thereof.

Also according to the underground shelter of the present invention, the shelter outer shell is made of high-strength reinforced concrete mixed with conductive fibers or conductive powders so that the shelter outer shell is conductive. The term conductive fibers or conductive powders mean carbon fibers, carbon powders, and metal powders for example.

Also according to the underground shelter of the present invention, the outer surface of the shelter outer shell or the inner shell surface is covered by a member including neutron beam-shielding substance. The main body of the shelter is composed of an inner shell, an outer shell, and a neutron beam-shielding shell. The term "member including neutron beam-shielding substance" means a member obtained by molding high-density polyethylene, and high-density polyethylene to which boric oxide is added to have a flat plate-like or block-like shape. When this neutron beam-shielding shell is composed of a polyethylene plate that is weak to heat and fire disaster, the influence by heat can be avoided by providing the polyethylene plate at the inner shell surface of the shelter outer shell, for a portion recognized as being easily influenced by heat (e.g., shelter doorway).

Also according to the underground shelter of the present invention, the shelter outer shell is made of high-strength reinforced concrete mixed with material including powder-like or granular neutron beam-shielding substance. The term "neutron beam-shielding substance" means boron carbide and concentrated boron for example. This concentrated boron is obtained by increasing, with regards to two types of isotopes of boron-10 (10B) and boron-11 (11B) of natural boron (having the same number of protons and different numbers of neutron), the concentration of 10B having a superior absorption capacity to neutron beam at an abundance ratio of about 20% in the natural world to about 95% to the concentration of 11B having substantially no absorption capacity so that a neutron beam absorption capacity about 5 times higher than that of natural boron is achieved.

Also according to the underground shelter of the present invention, a sheathing-integrated-type shelter outer shell floor slab is provided in which a side face of the shelter outer shell floor slab provided in the ground is integrated with a sheathing sheet pile, a sheathing pile, a sheathing column wall, and a sheathing continuous underground wall that are provided in the ground and that are not removed.

The underground shelter provided in the ground may be easily influenced, depending on the ground conditions, by the liquefied ground due to a big quake or oscillation such as an earthquake motion. The situation as described above causes a big upward buoyant force in the vertical direction that acts on the bottom section of the main body of the underground shelter. Such a buoyant force causes a risk where even the underground shelter may be buoyant. Although it is rare for the shelter to be completely surfaced, when the upper part of underground shelter has thereon an above-ground structure, this structure may be surfaced to incline the above-ground structure or to cause a fatal impact on the above-ground structure. When the underground shelter is constructed under the ground conditions as described above, a sheathing work must be performed prior to a drilling work. The sheathing work is a work in order to prevent the peripheral ground from being broken when the ground is drilled. The sheathing work includes a parent pile sheet pile method, a steel sheet pile method, a column method, and a continuous wall method. The respective methods provide a strong sheathing effect under appropriate ground conditions. A sheathing member used for this sheathing is not removed and the reinforcing steel and the section steel assembled with the sheathing member are integrated with the reinforcing steel and the concrete constituting the shelter outer shell floor slab. This consequently provides a structure that is strong to the influence by the liquefaction phenomenon due to an earthquake motion for example.

Also according to the underground shelter of the present invention, the sheathing-integrated-type shelter outer shell is provided in which a side face of the shelter outer shell floor slab and a wall face of the shelter outer shell provided in the ground are integrated with a sheathing sheet pile, a sheathing pile, a sheathing column wall, and a sheathing continuous underground wall that are provided in the ground and that are not removed. Generally, the wall face of the shelter outer shell is formed by providing the shelter inner shell after the formation of the shelter outer shell floor slab to subsequently allow a worker to assemble the reinforcing steel and a formwork so as to cover the shelter inner shell to flow ready-mixed concrete therein. This wall face of the outer shell of the sheathing-integrated-type shelter is formed by allowing, after the formation of the shelter outer shell floor slab and prior to the placement of the shelter inner shell, a worker to start assembling the reinforcing steel of the wall face of the shelter outer shell at a position at which the shelter inner shell is to be provided. Then, the worker places the shelter inner shell to flow ready-mixed concrete for the wall face of the shelter, thereby completing the wall face of the shelter outer shell.

Also according to the underground shelter of the present invention, a pile-integrated-type shelter outer shell floor slab is provided in which the bottom face of the shelter outer shell floor slab provided in the ground is fixedly connected to and is integrated with a pile driven in the ground. This pile is provided when the shelter is provided in a weak ground. Specifically, after drilling the ground, the drilling bottom face is bulldozed and this pile is driven into the ground until a safe ground is reached. Thereafter, the pile is cut to have a predetermined height that can be accommodated in the shelter outer shell floor slab. Then, even concrete is provided at the drilling bottom face to form the shelter outer shell floor slab.

Effect of the Invention

The underground shelter according to the present invention can effectively protect the interior thereof from factors of an earthquake shock due to an earthquake, explosion-related shock wave, blast wave pressure, oscillation, heat, fire disaster, gamma beam, neutron beam, bomb pieces, dust, gas, electromagnetic waves, underground water, and flood. When the underground shelter is covered with soil, the main body of the underground shelter is difficult to find, thus improving the crime prevention.

When a metal plate constituting the shelter inner shell is an iron plate, the shelter inner shell is covered by strongly-alkaline concrete constituting the shelter outer shell. Thus, the outer surface of the iron plate constituting the shelter inner shell has thereon an oxide film. This can provide high durability without requiring an additional special corrosion-resistant and rust-prevention coating. In particular, iron and concrete having substantially the same thermal expansion coefficient and the high attachment force therebetween can effectively provide an integrated structure that can have a strong armored wall provided in the ground.

In particular, according to the invention of this application, the box-like shelter inner shell made of a metal plate includes a load-bearing partition wall so that the load-bearing partition wall is separated from the shelter outer shell. This can prevent water or moisture from intruding through the shelter outer shell to the load-bearing partition wall, thus securing the waterproofing property. Furthermore, the interior of the shelter inner shell is partitioned to a plurality of compartments. This can dramatically improve the earthquake protection and the blastproof property. The respective compartments can be used depending on applications, thus improving the functionality of the interior of the underground shelter. For example, the interior of the underground shelter can be divided into a doorway room, a main room, a sub room, and a mechanical room. The doorway room can be used as an air lock room to prevent contaminated air from the outside from intruding into the main room. The mechanical room can collectively accommodate mechanical appliances and can isolate noise, oscillation, exhaust gas, and heat for example. The sub room can be used as a storeroom. Thus, the respective rooms can have functionality.

Furthermore, the load-bearing partition wall made of high-strength reinforced concrete is provided by flowing ready-mixed concrete through the opening provided in the ceiling section of the shelter inner shell to subsequently seal the opening with the metal cover. Thus, the main body of the shelter can have a significantly-improved strength while providing the main body of the shelter with a secure waterproofing property. This opening through which ready-mixed concrete is flowed is provided so as to penetrate the outer surface and the interior of the shelter inner shell so that the ready-mixed concrete can reach upper ends of the previously-provided reinforcing steel and formwork to which the concrete is difficult to reach. Thus, a load-bearing partition wall having an expected strength can be provided at an arbitrary position with an arbitrary wall thickness. Furthermore, a fireproof partition wall can be provided that can sufficiently endure even a fire disaster in a compartment.

By the structure in which the box-like shelter inner shell made of a metal plate has a haunch chamfered face, the inner shell face of the shelter outer shell provided to cover the outer surface of the shelter inner shell can have a more dynamically-stable concrete structure having a haunch. Furthermore, a haunch frame can be provided in the reinforcing steel of the haunch section. Thus, the shelter outer shell can have high structural safety.

As in general steel-made underground rooms, the shelter can be assembled on site by assembling units and panels standardized in a plant. Thus, the shelter can be assembled and provided with a short period. Furthermore, when the ready-mixed concrete for the shelter outer shell is filled, the shelter inner shell can function as a formwork. Thus, the cost for the formwork work can be reduced and a reduced work period can be achieved. Furthermore, the shelter inner shell also can function as a metal structure to fix the base member so that packaging members in the shelter can be prevented from being peeled due to earthquake motion, impact, or oscillation.

The box-like shelter inner shell made of a metal plate is connected to the ground covering the entirety of the main body of the shelter via a grounding wire member to provide an electrical grounding wire. Thus, the electromagnetic wave-shielding performance can be improved.

The shelter outer shell is made of high-strength reinforced concrete mixed with conductive fibers or conductive powders to provide conductive concrete. Thus, the shelter outer shell is electrically integrated with the shelter inner shell made of a metal plate. Thus, a synergetic effect can be provided to improve the electromagnetic wave-shielding property.

The outer surface or the inner shell face of the shelter outer shell is covered by a member including neutron beam-absorbing substance so that the main body shelter is composed of the inner shell, the outer shell, and the neutron beam-shielding shell. Thus, a stronger neutron beam-shielding performance can be achieved. When a neutron beam-shielding shell composed of a plate-like member having a neutron beam shield capacity covers the wall section and the ceiling section of the outer surface of the shelter outer shell, this structure also can be used as a formwork through which concrete for the wall section of the shelter outer shell is flowed. Thus, the construction cost can be reduced.

The shelter outer shell is made of the high-strength reinforced concrete mixed with material powder-like or granular neutron beam-absorbing substance. This can dramatically improve the neutron beam-shielding performance of the shelter outer shell.

The load-bearing partition wall composed of high-strength reinforced concrete and a metal plate can function as a load-bearing partition wall having an electromagnetic wave-shielding performance. Furthermore, the metal plate can function as a formwork through which ready-mixed concrete for the load-bearing partition wall is flowed. Thus, the load-bearing partition wall can be integrated with the high-strength reinforced concrete, thus providing a load-bearing partition that can be easily constructed and that is durable. This load-bearing partition wall having an electromagnetic wave-shielding performance is particularly required in an underground shelter having a simple specification described later.

By the sheathing-integrated-type shelter outer shell floor slab in which a side face of the shelter outer shell floor slab provided in the ground is integrated with a sheathing sheet pile, a sheathing pile, a sheathing column wall, and a sheathing continuous underground wall that are provided in the ground and that are not removed, the downward withdrawal resistance in the vertical direction owned by the sheathing member can cancel the upward buoyant force in the vertical direction caused in a liquefaction phenomenon. Thus, the earthquake protection can be significantly improved. Thus, the underground shelter can be provided in a weak ground. Thus, the disadvantages related to earthquake protection and structural safety can be solved.

By the sheathing-integrated-type shelter outer shell floor slab in which the side face of the shelter outer shell floor slab provided in the ground and the wall face of the shelter outer shell are integrated with the sheathing configuration members such as the sheathing sheet pile, the sheathing pile, the sheathing column wall, and the sheathing continuous underground wall that are provided in the ground and that are not removed, the downward withdrawal resistance in the vertical direction owned by the sheathing member can cancel the upward buoyant force in the vertical direction caused in a liquefaction phenomenon. Thus, the main body of the shelter can be integrated with the sheathing members more securely, thus improving the earthquake protection. Furthermore, this configuration does not require a working passage between the sheathing member and the shelter outer shell through which reinforcing steel and a formwork are assembled. Thus, the drilling work scope can be reduced and backfilling soil for this part is not required. Thus, the earthquake protection can be significantly improved in an economic manner.

By the pile-integrated-type shelter outer shell floor slab in which the bottom face of the shelter outer shell floor slab provided in the ground is integrated with a pile driven in the ground, even an underground shelter having a large floor area can have an increased resistance to an external force such as an earth pressure variation or a buoyant force due to earthquake motion. Thus, the earthquake protection can be improved.

BEST MODE FOR CARRYING OUT THE INVENTION

There is described hereinafter a preferred embodiment of the present invention with reference to the drawings.

Figure 1:
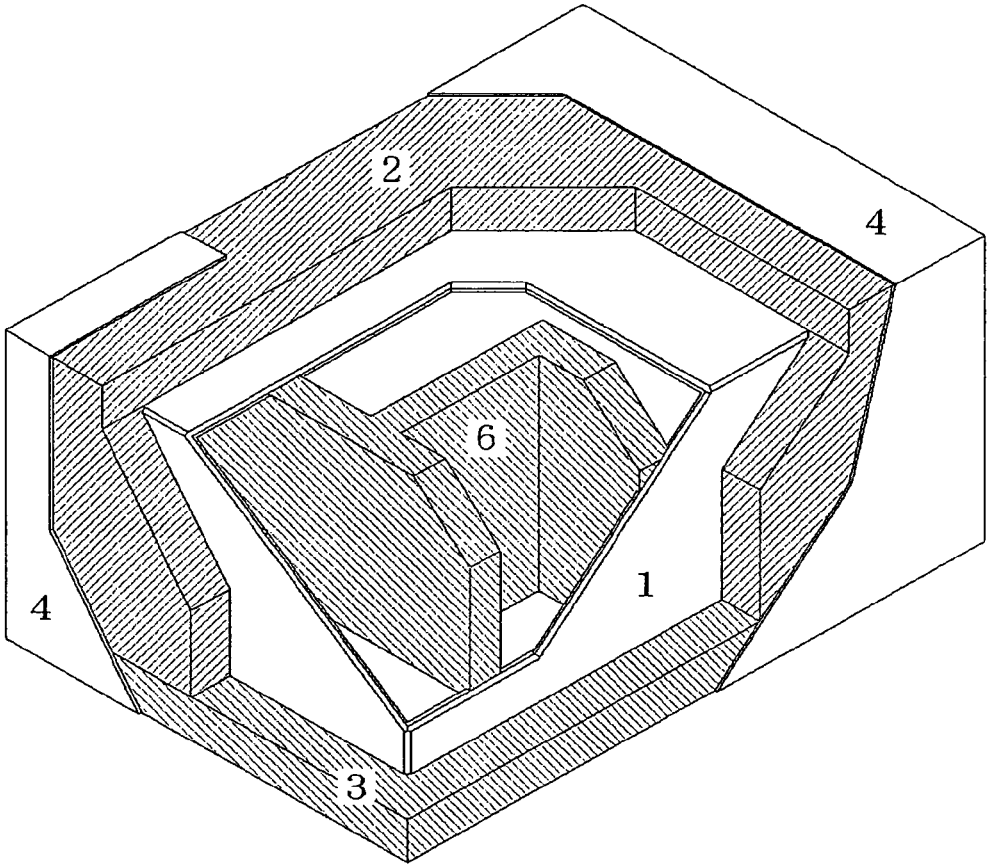
FIG. 1 is a structure concept diagram illustrating an embodiment of the present invention in which a part thereof is cut away.

FIG. 1 is a structure concept diagram illustrating the underground shelter of the present invention in which a part thereof is cut away. FIG. 1 shows a basic concept of the basement floor constructed at a position below the ground surface.

A hole is drilled at a depth of about 5 to 6 m from the ground surface. Then, the bottom face is bulldozed and even concrete 22 for improving the workability mainly in a surveying process is casted for the preparation to provide the shelter. Thereafter, the concrete has thereon a shelter outer shell floor slab 3 made of high-strength reinforced concrete provided at the lowest position in the main body of the shelter. On the shelter outer shell floor slab 3, a shelter inner shell 1 made of a metal plate is provided. Next, a load-bearing partition wall 6 made of high-strength reinforced concrete is provided in the shelter inner shell 1. Thereafter, a shelter outer shell 2 is formed so as to cover the periphery of the outer surface except for the shelter outer shell floor slab 3-side of the shelter inner shell 1.

If required, a neutron beam-shielding shell 4 is provided at the outer surface-side of the wall section and the ceiling section of the shelter outer shell 2 or the shelter inner shell 1-side to subsequently backfill the beam-shielding shell 4. Although FIG. 1 shows the neutron beam-shielding shell 4 covering the surface of the shelter outer shell 2, the same effect also can be obtained by the beam-shielding shell 4 sandwiched between the shelter inner shell 1 and the shelter outer shell 2.

Figure 10:
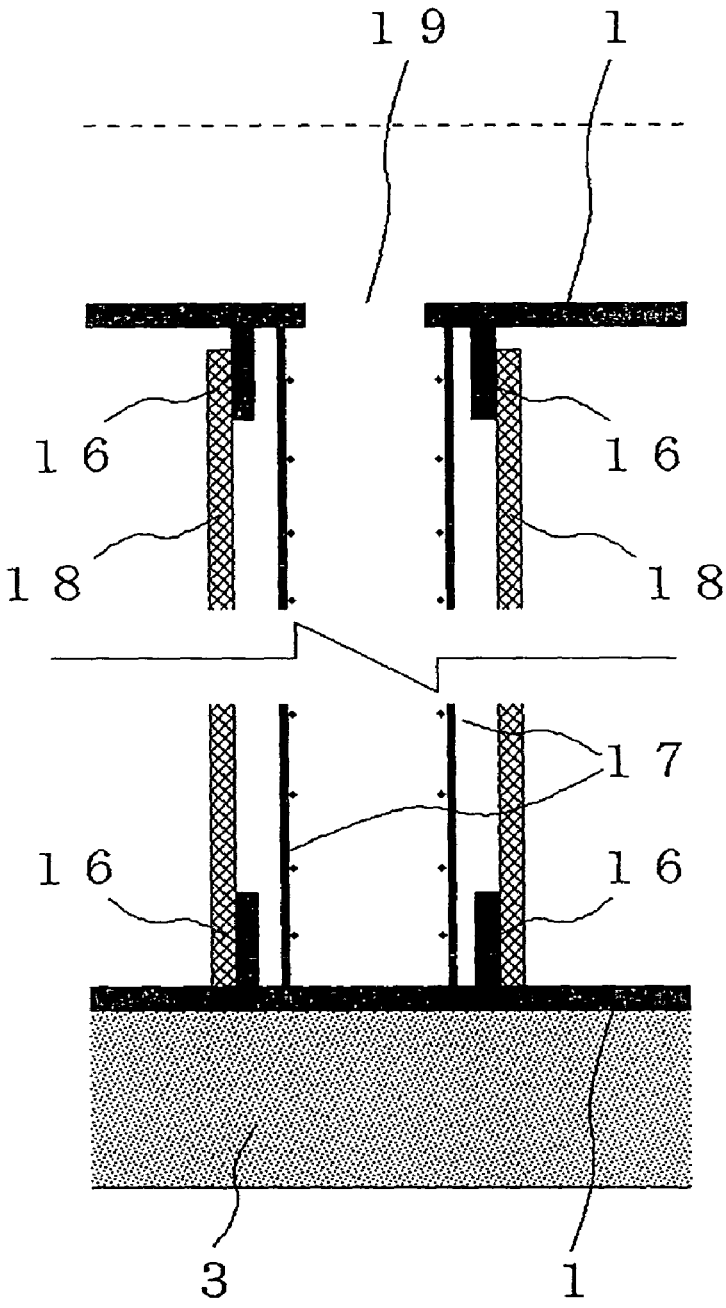
FIG. 10 is a cross-sectional view illustrating a load-bearing partition wall prior to the filling of concrete showing an embodiment of the present invention.
Figure 11:
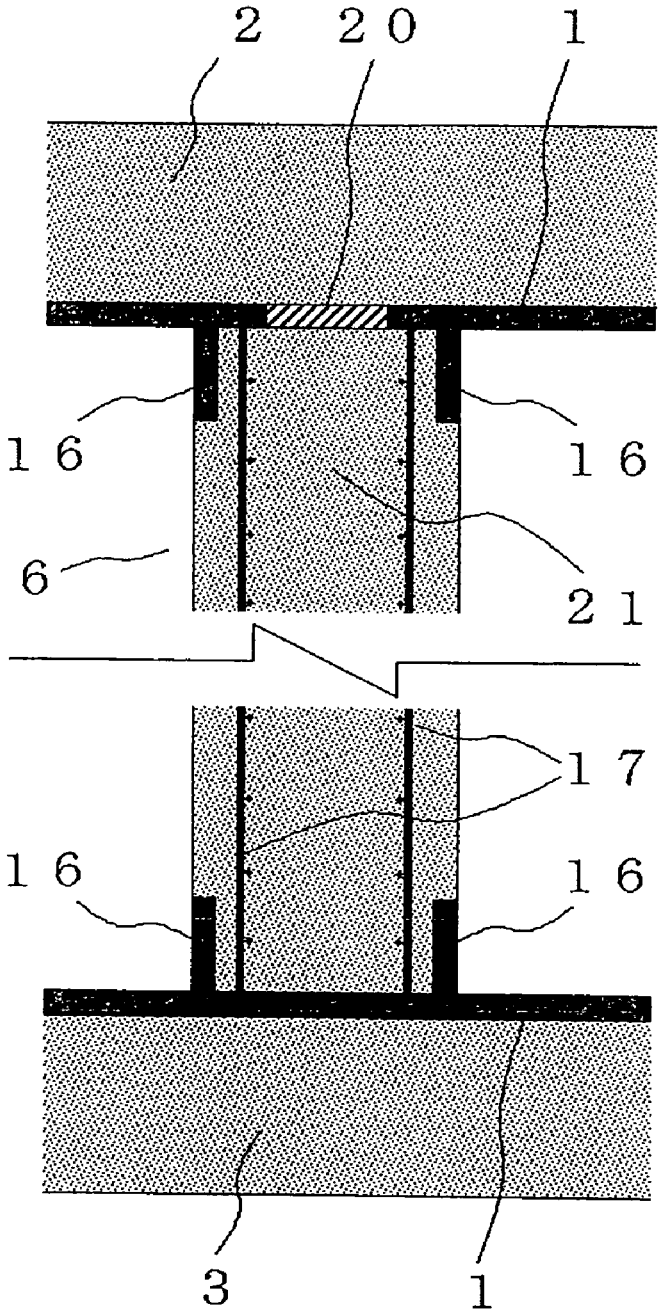
FIG. 11 is a cross-sectional view illustrating a load-bearing partition wall showing an embodiment of the present invention after the filling of concrete and the disassembly of a formwork.

With regards to the load-bearing partition wall 6 that is provided in the shelter inner shell 1 and that is made of high-strength reinforced concrete, formwork guides 16 for forming a load-bearing wall having an arbitrary wall thickness as shown in FIG. 10 and FIG. 11 are provided in advance at arbitrary positions of the inner side of the shelter inner shell 1. The existence of the formwork guides 16 allows, after the placement of the shelter inner shell 1, reinforcing steel 17 and formworks 18 to be assembled promptly with a high accuracy. By flowing ready-mixed concrete through an opening 19 provided in the ceiling section of the shelter inner shell 1 constituting the load-bearing partition wall 6, ready-mixed concrete can be casted to reach the upper end constituting the load-bearing partition wall 6. Thus, the load-bearing wall and the partition wall can be robust and can have very high airtightness. Since the opening 19 is sealed by a metal cover 20 after the filling of concrete, the load-bearing partition wall 6 is separated from the shelter outer shell 2, thus preventing a deteriorated waterproofing property.

Figure 2:
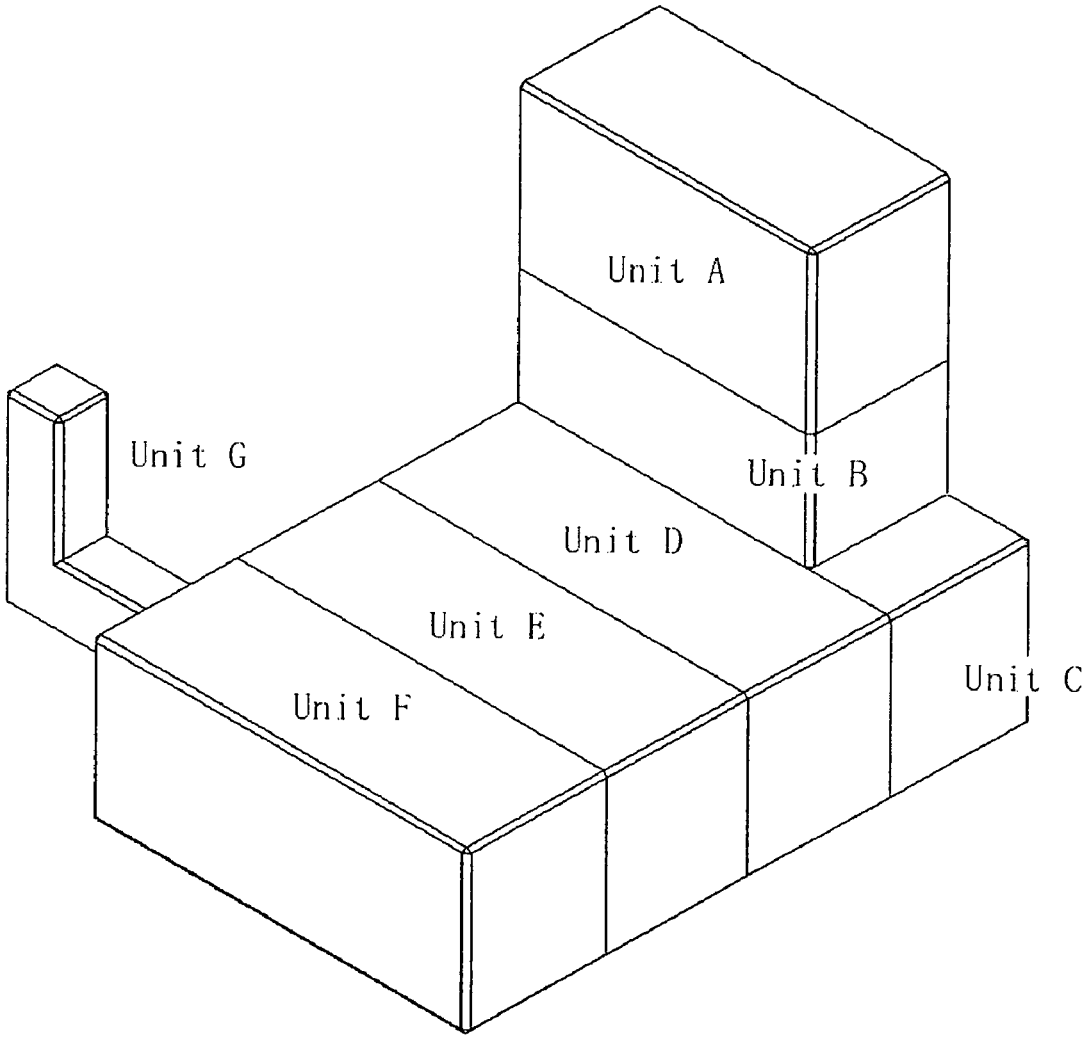
FIG. 2 illustrates the appearance of a standardized inner shell showing an embodiment of the present invention.

FIG. 2 illustrates the appearance of the shelter inner shell 1 that is composed of a plurality of standardized units or panels. For example, when FIG. 2 is compared with FIG. 4 (a top view of a basement floor illustrating an embodiment), units A and B can be used for a doorway room (1*a*), a unit C can be used for the doorway room (1*a*) and a mechanical room (1*d*), a unit D can be used for a main room (1*b*), a unit E can be used for the main room (1*b*) and a sub room (1*c*), a unit F can be used for the sub room (1*c*), and a unit G can be used for an emergency egress tunnel (1*e*).

In the case of units or panels of a conventional box-type underground room having the same structure, all finished box-like corners after the assembly are composed of joint areas having a right angle. In the case of an underground shelter however, the shelter outer shell 2 made of high-strength reinforced concrete that resists a high external force must be provided. In order to provide the shelter outer shell 2 with a more ideal quality of finished concrete and a bar arrangement, the corners of the outer surface-side of the shelter inner shell 1 made of a metal plate have haunch chamfered sections for providing haunch at the inner side of the shelter outer shell 2. This allows a haunch frame to be provided in the reinforcing steel, thus providing the reinforced concrete with a more ideal finished work quality. This shelter inner shell 1 also functions as a formwork into which concrete is casted. Thus, the cost for the formwork work can be reduced and the work period can be shortened.

Figure 3:
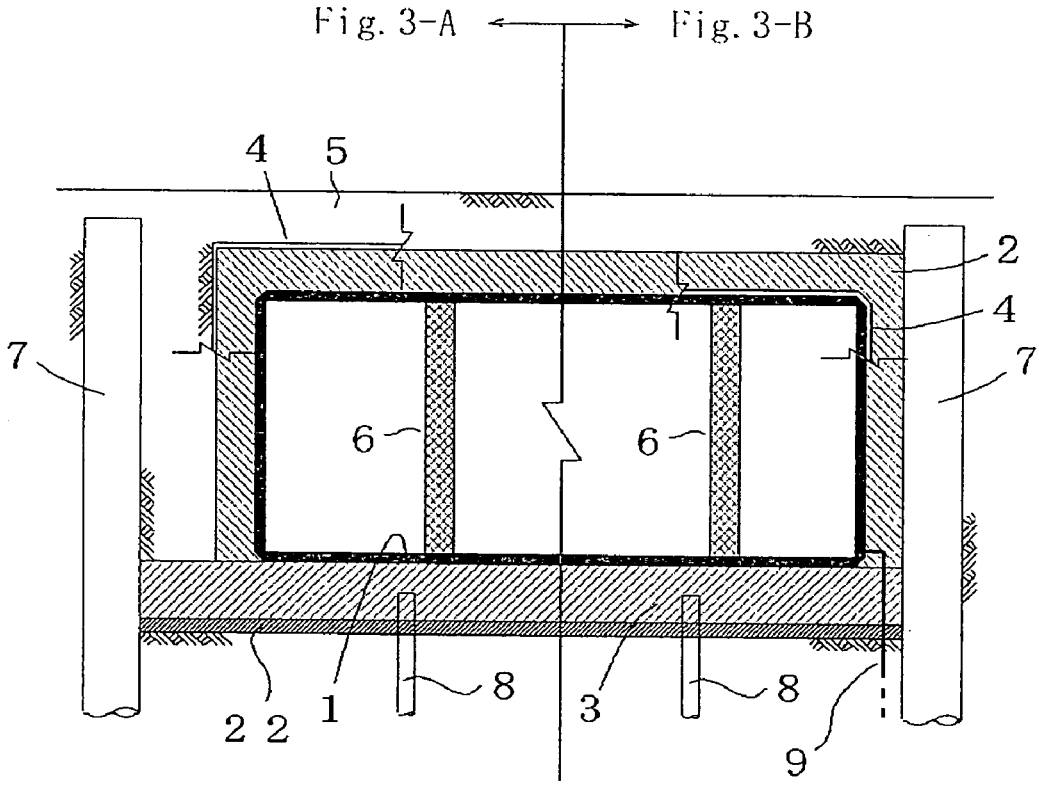
FIG. 3 is a typical cross-sectional view illustrating a basement floor showing an embodiment of the present invention.

FIG. 3 (FIG. 3-A and FIG. 3-B) illustrates the cross sections of the basement floor in which the structure in FIG. 1 is buried in the ground. FIG. 3 is a concept diagram illustrating that a part of a sheathing work member provided in a drilling work in the construction work of the underground shelter is not removed and is integrated with the main body of the underground shelter.

FIG. 3-A shows the shelter outer shell floor slab 3 made of the high-strength reinforced concrete and conductive high-strength reinforced concrete provided in the ground is integrated with the sheathing member 7 by reinforcing steel, steel member, and concrete. FIG. 3-B illustrates that the shelter outer shell floor slab 3, the wall face of the shelter outer shell 2, and the sheathing member 7 are integrated by reinforcing steel, a steel member, and concrete. This configuration does not require a working passage of about 1.0 to 0.7 m for the assembly of reinforcing steel and a formwork between the sheathing member and the shelter outer shell. Thus, the drilling work scope can be reduced. The shown piles 8 are so structured that a part of the upper part thereof is integrated with the shelter outer shell floor slab 3. The piles 8 can provide a higher earthquake protection even when the shelter is constructed in weak ground at a high underground water level.

In FIG. 3, cover soil 5 also has a significant meaning to the underground shelter. Specifically, the cover soil 5 on the surface of the ceiling of the shelter outer shell 2 can improve the shielding performance against heat due to fire disasters and gamma radiation due to a nuclear radiation disaster and also can make the main body of the underground shelter to be difficult to find from above the ground, thus improving the crime prevention.

Figure 12:
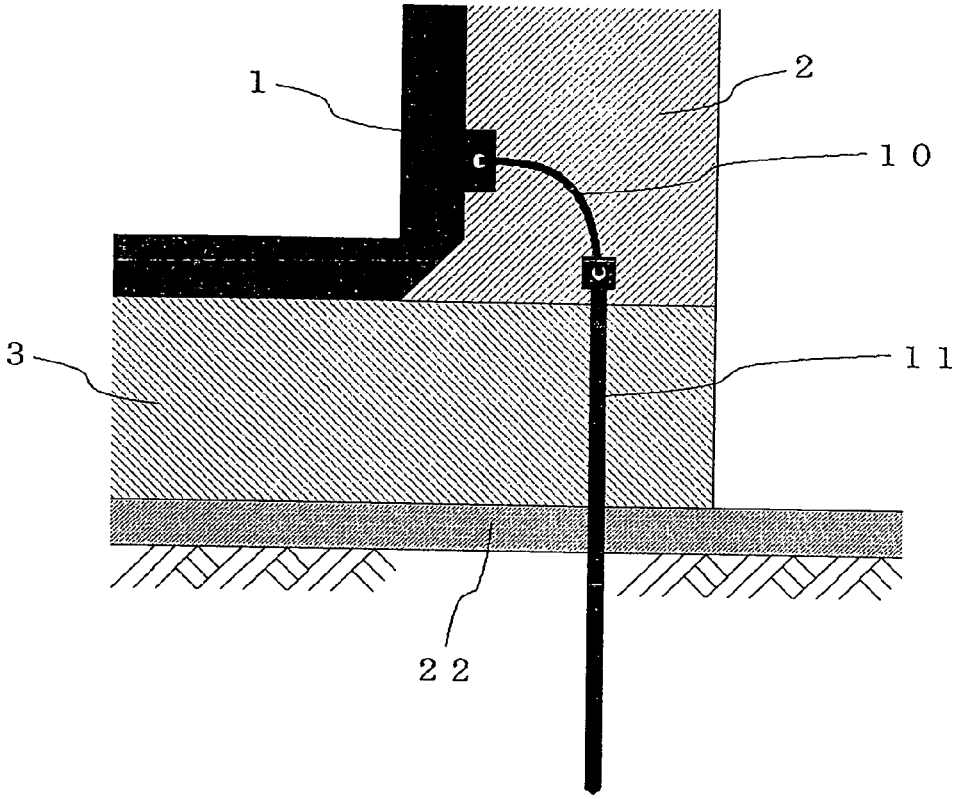
FIG. 12 illustrates a configuration of a grounding wire member.

In FIG. 3, a grounding wire member 9 is provided by electrically joining the shelter inner shell 1 to the ground covering the outer surface of the main body of the shelter. FIG. 12 shows that a metal bar 11 is driven into the ground prior to the casting of even concrete 22 to subsequently provide the shelter outer shell floor slab 3 made of the even concrete 22 and high-strength reinforced concrete. Then, the shelter inner shell 1 is provided on the shelter outer shell floor slab 3 to subsequently connect the upper end of the metal bar 11 to a connection metal structure provided in the shelter inner shell 1 via a metal cord 10. Thereafter, these components are covered by the shelter outer shell 2. This structure can improve the electromagnetic wave-shielding performance. Thus, when the shelter outer shell 2 and the shelter outer shell floor slab 3 are made of conductive high-strength reinforced concrete, a synergetic effect can be achieved.

Figure 4:
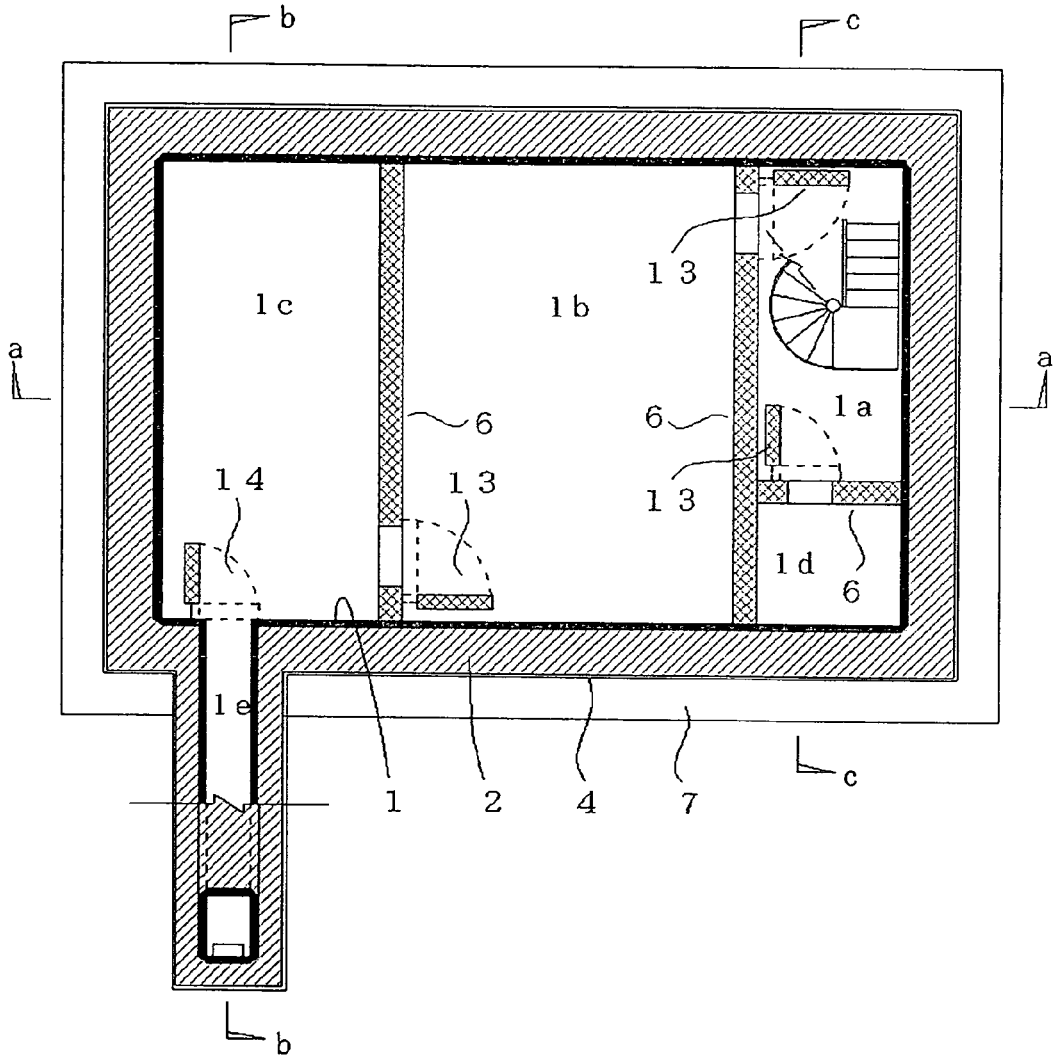
FIG. 4 is a top view illustrating the basement floor showing an embodiment of the present invention.
Figure 5:
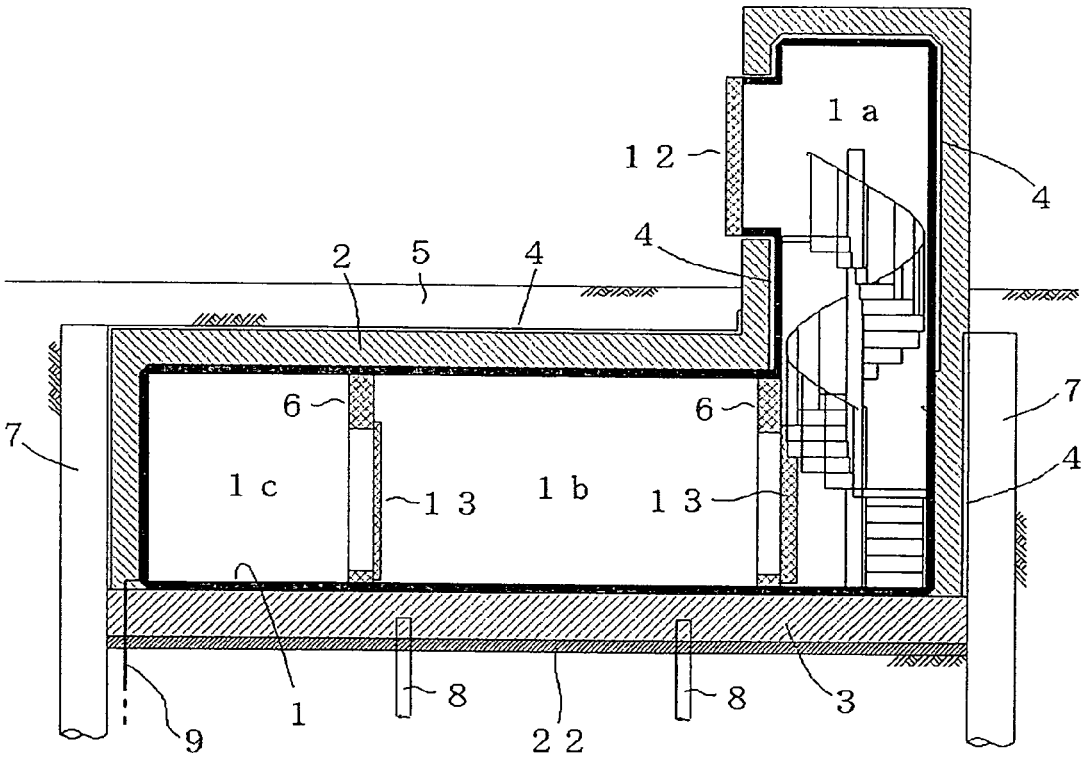
FIG. 5 is a cross-sectional view illustrating the underground shelter showing an embodiment of the present invention taken along the line a-a (standard specification).
Figure 6:
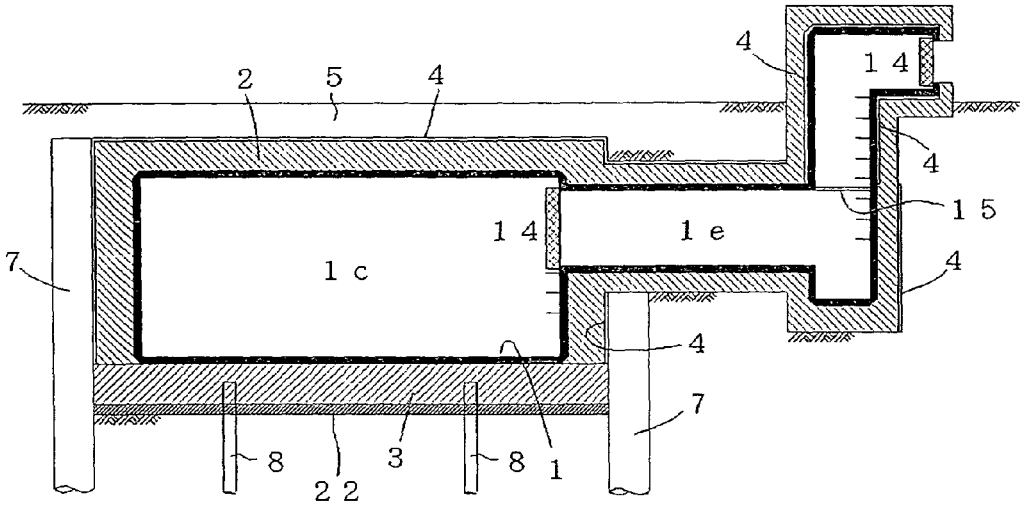
FIG. 6 is a cross-sectional view illustrating the underground shelter showing an embodiment of the present invention taken along the line b-b.
Figure 7:
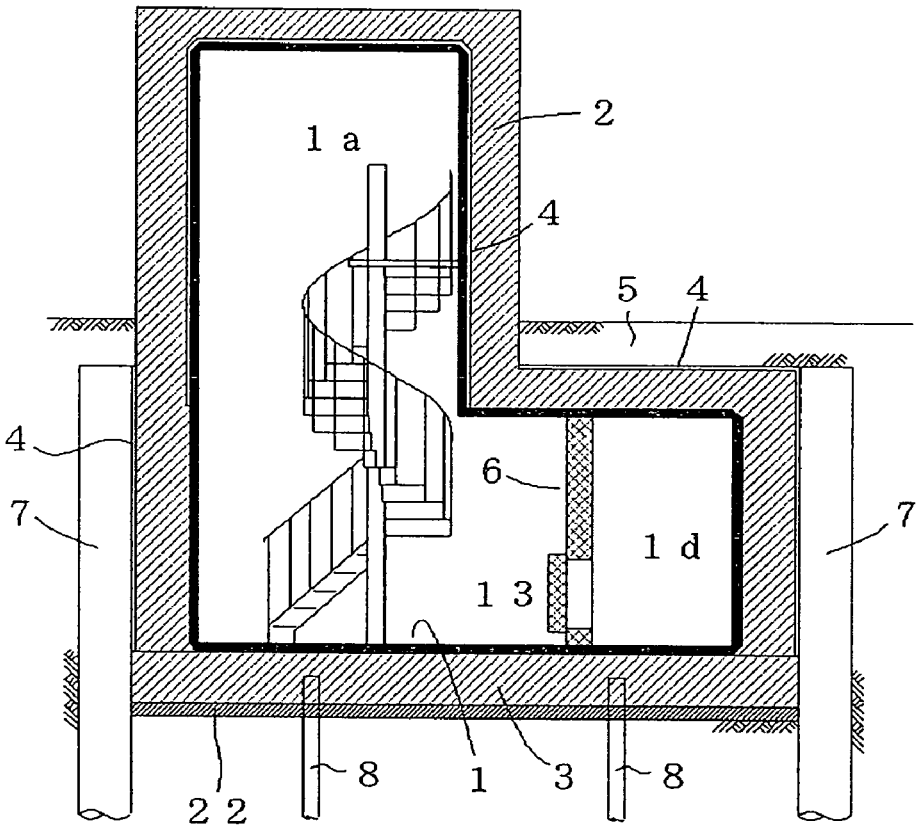
FIG. 7 is a cross-sectional view illustrating the underground shelter showing an embodiment of the present invention taken along the line c-c (standard specification).

FIG. 4 is a top view of the basement floor illustrating a preferred embodiment of the underground shelter of the present invention. In FIG. 4, the reference numeral 1*a* denotes a doorway room, the reference numeral 1*b* denotes a main room, the reference numeral 1*c* denotes a sub room, the reference numeral 1*d* denotes a mechanical room, and the reference numeral 1*e* denotes an emergency egress tunnel. These compartments are partitioned by the load-bearing partition wall 6. The main body of the shelter has a double or triple structure that is composed of the shelter inner shell 1 and the shelter outer shell 2 or the shelter inner shell 1, the shelter outer shell 2, and the neutron beam-shielding shell 4.

FIGS. 5 to 9 are longitudinal sectional views of FIG. 4.

The underground shelter according to the present invention has a standard specification (FIG. 5 and FIG. 7) and a simple specification (FIG. 8 and FIG. 9) different in the shape of a protrusion of the doorway protruded above the ground. The standard specification and the simple specification are selected based on customer requirements such as location conditions (including the possibility of a water immersion disaster due to flood at a site at which the shelter is to be constructed) and the construction cost. In the case of standard specification in FIG. 5 and FIG. 7, the above-ground protrusion is composed of the shelter inner shell 1, the shelter outer shell 2, and the neutron beam-shielding shell 4. The doorway has the shelter inner shell-integrated armored door 12 that functions to protect the interior against explosion-related shock wave, blast wave pressure, oscillation, nuclear radiation, bomb pieces, dust, gas, fire disaster, and heat, electromagnetic wave, and flood. Thus, a perfect structure against any types of disaster can be provided.

Figure 8:
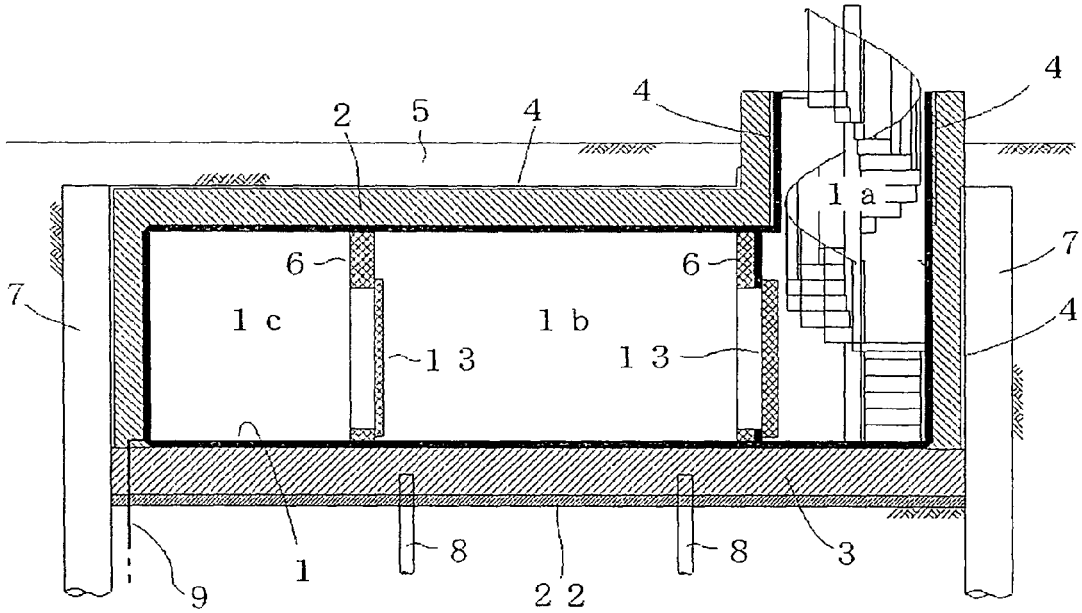
FIG. 8 is a cross-sectional view illustrating the underground shelter showing an embodiment of the present invention taken along the line a-a (simple specification).
Figure 9:
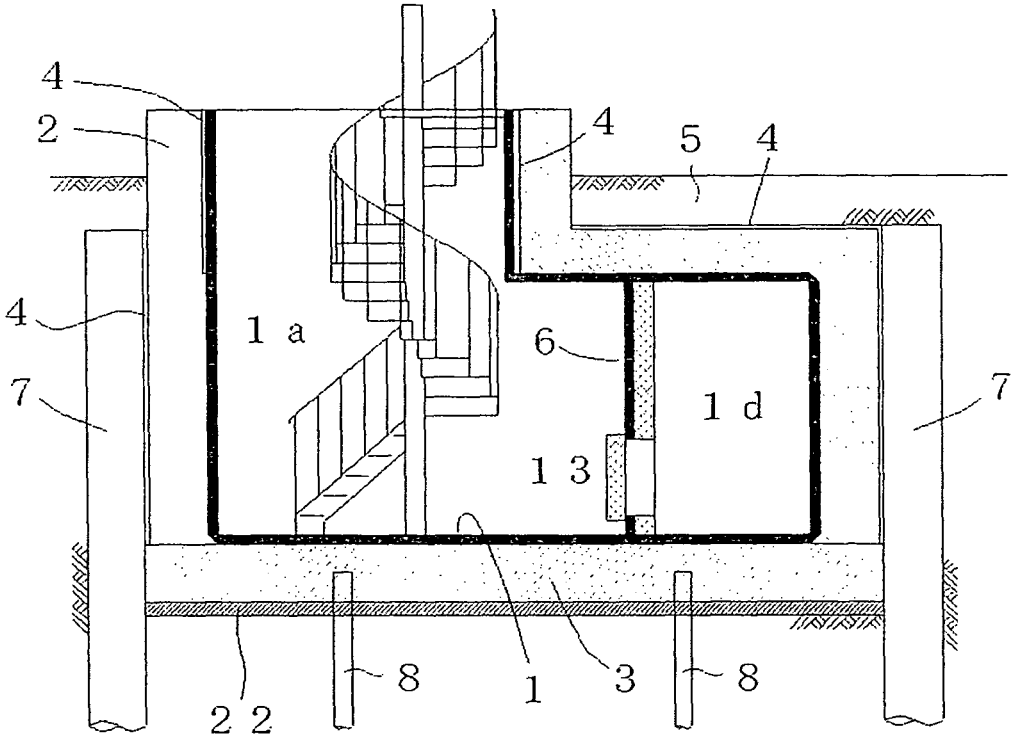
FIG. 9 is a cross-sectional view illustrating the underground shelter showing an embodiment of the present invention taken along the line c-c (simple specification).

However, when the shelter is provided in a region for which water immersion disasters due to flood are rare, the simple specification as shown in FIG. 8 and FIG. 9 can be used. The simple specification does not intentionally include the protrusion that is positioned above the above-ground staircase landing and that is composed of the shelter inner shell 1 and the shelter outer shell 2 as well as the shelter inner shell-integrated armored door 12 at the above-ground doorway. In the case of the simple specification however, the electromagnetic wave-shielding property is lost. Thus, the electromagnetic wave-shielding property is provided by allowing the load-bearing partition wall 6 for partitioning the doorway room (1*a*) from a neighboring compartment to be composed of high-strength reinforced concrete and a metal plate to have an electromagnetic wave-shielding property.

In the standard specification and the simple specification, the doorway room (1*a*) has elevation equipment composed of a spiral stair and a straight stair. Thus, the doorway room (1*a*) can effectively cope with the depth at which the underground shelter is buried. The load-bearing partition wall 6 that partitions the doorway room (1*a*) from the main room (1*b*), the doorway room (1*a*) from the sub room 2 (1*d*), and the main room (1*b*) from the sub room 1 (1*c*) includes the load-bearing partition wall-integrated armored door 13. Thus, in the case of the standard specification, spaces required for the function of the shelter can be secured by allowing the doorway room to function as an air lock room and a decontamination room for removing radioactive material, by allowing the sub room 1 (1*c*) to function as a storage room, and by allowing the sub room 2 (1*d*) to function as a mechanical room.

When the shelter is used as an emergency evacuation underground shelter, the emergency egress tunnel (1*e*) must be provided in a compartment other than the doorway room (1*a*). The emergency egress tunnel (1*e*) is an exclusive path for the safe and secure evacuation from the underground to the above-ground when the shelter inner shell-integrated armored door 12 and the load-bearing partition wall-integrated armored door 13 can not be opened or when a fire disaster occurs in the doorway room (1*a*) and the interior of the shelter is dangerous. This emergency egress tunnel (1*e*) is the shelter inner shell 1 itself. The emergency egress tunnel (1*e*) can be provided at an arbitrary position by units and panels. It is desirable that a small armored door 14 is provided at the interior-side of the emergency egress tunnel (1*e*) and the exit-side of the tunnel and an armored hatch 15 is provided at the middle.

In FIG. 5 to FIG. 9, the neutron beam-shielding shell 4 constituting the main body of the shelter is provided, in order to protect the shelter from fire and heat due to fire disasters, at the outer surface-side of the shelter outer shell 2 when the neutron beam-shielding shell 4 is provided in the ground and at the inner surface-side of the shelter outer shell 2 when the neutron beam-shielding shell 4 is provided at a position near the ground or above the ground. Neutrons have a characteristic according to which, when neutrons having a kinetic energy stop, the neutrons emit gamma radiation. The concrete of the shelter outer shell 2 and the metal plate of the shelter inner shell 1 have a role to attenuate the gamma radiation.

The above explanation is made with respect to a case where the present invention is applied to a personal underground shelter, a public underground shelter, a nuclear power generation facility underground shelter, and a research facility underground shelter. However, the present invention also can be applied to various applications (e.g., a computer machine security underground shelter, an underground money safe, an underground stock room) by adjusting as required the characteristics of the components.

The invention claimed is:

1. An underground shelter, comprising:

a shelter outer shell made of high-strength reinforced concrete;

a box-like shelter inner shell that is provided in the shelter outer shell and that is made of a metal plate; and a load-bearing partition wall that partitions the interior of the shelter provided in the shelter inner shell to two or more compartments, wherein the shelter inner shell has an opening at a position of a ceiling section of the load-bearing partition wall formed in the shelter inner shell, and the load-bearing partition wall is formed by flowing ready-mixed concrete through the opening, which is subsequently sealed with a metal cover.

2. The underground shelter according to claim 1, wherein the box-like shelter inner shell made of a metal plate has a haunch chamfered face.

3. The underground shelter according to claim 1, wherein the box-like shelter inner shell made of a metal plate comprises a plurality of standardized units or panels.

4. The underground shelter according to claim 1, wherein the box-like shelter inner shell made of a metal plate is connected to ground via a grounding wire member.

5. The underground shelter according to claim 1, wherein the shelter outer shell is made of high-strength reinforced concrete mixed with conductive fibers and conductive powders.

6. The underground shelter according to claim 1, wherein an outer surface-side or an inner shell face-side of the shelter outer shell is covered by a member including neutron beam-shielding substance and a main body of the shelter is composed of the inner shell, the outer shell, and a neutron beam-shielding shell.

7. The underground shelter according to claim 1, wherein the shelter outer shell is made of high-strength reinforced concrete mixed with material including powder-like or granular neutron beam-shielding substance.

8. The underground shelter according to claim 1, wherein the load-bearing partition wall is composed of reinforced concrete and a metal plate.

9. The underground shelter according to claim 1, wherein the underground shelter has a sheathing-integrated-type shelter outer shell floor slab in which a side face of the shelter outer shell floor slab provided in the ground is integrated with a sheathing sheet pile, a sheathing pile, a sheathing column wall, and a sheathing continuous underground wall that are provided in the ground and that are not removed.

10. The underground shelter according to claim 1, wherein the underground shelter has a sheathing-integrated-type shelter outer shell floor slab in which a side face of the shelter outer shell floor slab provided in the ground and a wall face of the shelter outer shell are integrated with a sheathing sheet pile, a sheathing pile, a sheathing column wall, and a sheathing continuous underground wall that are provided in the ground and that are not removed.

11. The underground shelter according to claim 1, wherein the underground shelter has a pile-integrated-type shelter outer shell floor slab in which a bottom face of the shelter outer shell floor slab provided in the ground is integrated with a pile stamped in the ground.

* * * * *